United States Patent [19]

Ghandehari

[11] Patent Number: 4,776,902

[45] Date of Patent: Oct. 11, 1988

[54] METHOD FOR MAKING RARE EARTH-CONTAINING MAGNETS

[75] Inventor: Mohammad H. Ghandehari, Brea, Calif.

[73] Assignee: Union Oil Company of California, Los Angeles, Calif.

[21] Appl. No.: 856,823

[22] Filed: Apr. 28, 1986

Related U.S. Application Data

[62] Division of Ser. No. 595,290, Mar. 30, 1984, Pat. No. 4,601,754.

[51] Int. Cl.[4] ..... H01F 1/02

[52] U.S. Cl. ..... 148/103; 148/104; 419/12; 419/13; 419/14; 419/19; 419/20; 419/38

[58] Field of Search ..... 148/103, 104, 108; 419/12, 13, 14, 19, 20, 38

[56] References Cited

U.S. PATENT DOCUMENTS

| | | | |
|---|---|---|---|
| 3,701,695 | 10/1972 | Buschow et al. | 148/103 |
| 4,043,845 | 8/1977 | Dionne | 148/103 |
| 4,081,297 | 3/1978 | Nagel et al. | 148/103 |
| 4,135,953 | 1/1979 | Nagel et al. | 148/103 |
| 4,211,585 | 7/1980 | Inomata et al. | 148/103 |
| 4,497,672 | 2/1985 | Tawara et al. | 148/103 |

*Primary Examiner*—John P. Sheehan

*Attorney, Agent, or Firm*—Alan H. Thompson; Gregory F. Wirzbicki; Robert A. Franks

[57] ABSTRACT

Compositions for the production of rare earth-ferromagnetic-metal permanent magnets comprise mixtures of rare earth-ferromagnetic metal alloy powder and a lesser amount of a powdered second-phase sintering aid, wherein there is added up to about 2 percent by weight of a particulate refractory oxide, carbide, or nitride additive. Permanent magnets are prepared by mixing the components, aligning the mixture in a magnetic field, pressing and sintering. The refractory material inhibits grain growth in the second phase during sintering, improving the magnetic properties of the major phase.

22 Claims, 2 Drawing Sheets

METHOD FOR MAKING RARE EARTH-CONTAINING MAGNETS

CROSS REFERENCE TO RELATED APPLICATION

This application is a division of U.S. patent application Ser. No. 595,290, filed Mar. 30, 1984, now U.S. Pat. No. 4,601,754.

This invention relates to rare earth ferromagnetic metal alloy compositions for producing rare earth-containing permanent magnets, and to magnet production methods utilizing the compositions.

Permanent magnets, defined as materials which exhibit permanent ferromagnetism (the ability to maintain magnetism following removal from a magnetizing field), have long been useful industrial materials, finding extensive applications in such devices as meters, loudspeakers, motors, and generators.

The more thoroughly developed permanent magnet compositions, for applications requiring the highest available residual magnetic strength, are alloys which contain rare earths and the ferromagnetic metals. Alloys of samarium and cobalt, sometimes containing minor amounts of other metals (such as iron, manganese, chromium, vanadium, aluminum, and copper—disclosed by Menth et al. in U.S. Pat. No. 4,131,495), have found considerable commercial success. A typical commercial samarium-cobalt magnet has the nominal empirical composition $SmCo_5$, prepared by mixing powdered $SmCo_5$ with a minor amount of samarium-cobalt alloy sintering aid which is richer in samarium than $SmCo_5$, aligning the mixture in a magnetic field, pressing the mixture into a desired shape, and sintering the shape. During sintering, the sintering aid becomes at least partially liquid, permitting a large density increase in the shape. This general method is described in U.S. Pat. No. 3,655,464 to Benz.

Due to the relatively high cost and scarcity of samarium, it has been found desirable to replace as much of the metal as possible with the more abundant (and, consequently, less expensive) rare earths, such as praseodymium, lanthanum, cerium, and misch metal. The highest theoretical magnet strengths, for alloys having an atomic ratio of ferromagnetic metal to rare earth of about 5, are obtained with praseodymium-cobalt alloys, but these strengths have not yet been obtained in practice. Examples of magnet materials thus produced are shown in U.S. Pat. No. 3,682,714 to Martin, and in references made therein to other patent applications. The patent shows magnets in which praseodymium constitutes 75 percent of the total rare earth content.

J. Tsui and K. Strnat, *Applied Physics Letters*, Vol. 18, No. 4, pages 107–8 (1971), describe the preparation of $PrCo_5$ magnets, using liquid-phase sintering aids containing either samarium and cobalt or praseodymium and cobalt.

Various methods have been used to prepare rare earth-containing magnets. Cech, in U.S. Pat. No. 3,625,779, mixes rare earth oxide and calcium hydride, then heats to reduce the oxide and form rare earth metal, which is melted with cobalt. The resulting alloy is then subjected to extensive treatments to remove even traces of formed calcium oxide, and used to produce magnets.

In general, it has been desirable to totally exclude oxygen from the rare earth-containing magnet production. U.S. Pat. No. 3,723,197 to Brischow et al. gives experimental evidence that $Sm_2O_3$, formed during the production of $SmCo_5$ magnets, is highly detrimental to the magnetic properties of the products. U.S. Pat. No. 4,043,845 to Dionne describes the use of carbon in mixtures of rare earth metal and cobalt, to prevent oxidation of rare earth-cobalt alloys.

Clegg, in U.S. Pat. No. 4,290,826, discloses a process for producing cobalt-rare earth alloys by mixing cobalt powder and refractory oxide powder, adding rare earth metal powder, and heating to form the alloy, without significant sintering. The avoidance of sintering is said to preserve the original small particle sizes, which improves the properties of magnets formed from the product powdered alloy.

Unsintered powders, however, must be bound together in resins, etc., to be useful as permanent magnets. The resulting low density of such magnets is reflected in the comparatively low magnetic strengths obtained. Further, the binders contribute to disadvantages such as the inability to use the magnets at elevated temperatures. In addition, sintered magnets have significantly greater mechanical strength.

Accordingly, it is an object of the present invention to provide compositions which form high strength rare earth-ferromagnetic metal permanent magnets.

It is a further object to provide compositions which can be sintered to form high strength rare earth-ferromagnetic metal permanent magnets.

A still further object is to provide a method for preparing sintered rare earth-ferromagnetic metal permanent magnets.

These, and other important objects, will become more apparent from consideration of the following description and the appended claims.

SUMMARY OF THE INVENTION

Compositions for the production of rare earth-ferromagnetic metal permanent magnets comprise: (1) a major amount of a particulate rare earth-ferromagnetic metal alloy; (2) a minor amount of a particulate alloy sintering aid which contains rare earth and ferromagnetic metal; and (3) about 0.1 to about 2 percent by weight of an additive material selected from the group consisting of refractory oxides, carbides, and nitrides.

A preparation of permanent magnets comprises: (1) mixing the rare earth-ferromagnetic alloy with the sintering aid; (2) adding to the mixture the additive material; (3) aligning the magnetic domains of the mixture in a magnetic field; (4) compacting the aligned mixture to form a shape; and (5) sintering the compacted shape.

Use of the additive material yields sintered magnets having both improved coercivities and more square demagnetization curves.

DESCRIPTION OF THE INVENTION

Figure 1A:
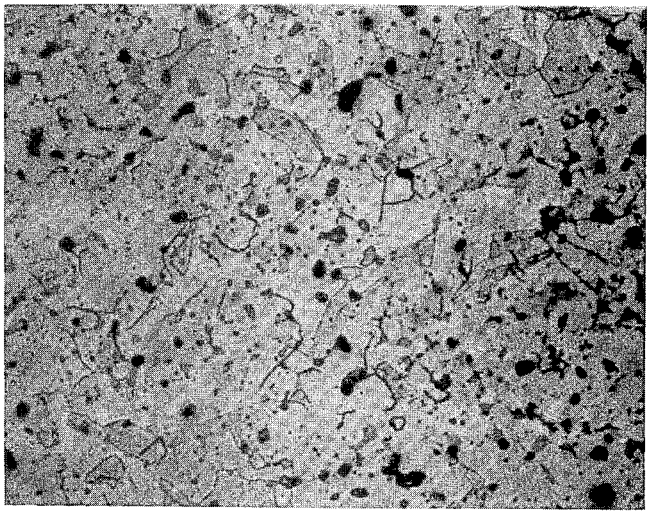
FIG. 1A is a photomicrograph showing the microstructure of a magnet prepared using only praseodymium-cobalt base alloy and a samarium-cobalt sintering aid.

As used herein, the term "rare earth" means the lanthanide elements having atomic numbers from 57 to 71, inclusive, and the element yttrium, atomic number 39, which is commonly found in rare earth concentrates and is chemically similar to the rare earths.

Ferromagnetic metals, for purposes of this invention, are iron, nickel, cobalt, and numerous alloys containing one or more of these metals. Ferromagnetic metals exhibit the characteristic of magnetic hysteresis, wherein the plots of induction versus applied field strengths (from zero to a high positive value, and then to a high negative value and returning to zero) are hysteresis loops.

Points on the hysteresis loop which are of particular interest for the present invention lie within the second quadrant, or "demagnetization curve," since most devices which utilize permanent magnets operate under the influence of a demagnetizing field. On a loop which is symmetrical about the origin, the value of field strength (H) for which induction (B) equals zero is called coercive force ($H_c$). This is a measure of the quality of the magnetic material. The value of induction where applied field strength equals zero is called residual induction ($B_r$). Values of H will be expressed in Oersteds (Oe), while values of B will be in Gauss (G). A figure of merit for a particular magnet shape is the energy product, obtained by multiplying values of B and H for a given point on the demagnetization curve and expressed in Gauss-Oersteds (GOe). When these unit abbreviations are used, the prefix "K" indicates multiplication by $10^3$, while "M" indicates multiplication by $10^6$. When the energy products are plotted against B, one point ($BH_{max}$) is found at the maximum point of the curve; this point will also be used herein as a criterion for comparing magnets. Intrinsic coercivity ($iH_c$) is found where (B-H) equals zero in a plot of (B-H) versus H.

The present invention is directed to the preparation of rare earth-ferromagnetic metal compositions, which can be used to fabricate high strength permanent magnets. These compositions comprise mixtures of rare earth-ferromagnetic metal alloy powder, usually, but not always, a powdered second-phase sintering aid, and up to about 2 percent by weight of a refractory oxide, carbide, or nitride additive.

Rare earth-ferromagnetic metal alloys which are useful in the present invention are those which possess ferromagnetic properties. Suitable alloys have been identified in the literature; the presently preferred alloys have an empirical formula approximating $RM_5$, wherein R is rare earth and M is ferromagnetic metal, as defined herein. Useful magnetic properties are also found in certain $RM_2$, $R_2M_7$, $R_2M_{17}$, and other alloys. The invention is exemplified herein by compositions based upon $PrCo_5$ alloys, but it is to be understood that no limitation is intended thereby.

Sintering aids are also rare earth-ferromagnetic metal alloys, either containing the same metals as do the major phase alloys or different metals. Proportions of the component metals, however, are chosen such that the sintering aid will be at least partially liquid at the chosen sintering temperature for the magnet. Presently preferred sintering aids are rare earth-ferromagnetic metal alloys which contain an excess of rare earth over that required for the formation of $RM_5$ compositions.

Sintering aid alloys are present in the mixed magnet compositions in lesser amounts than the major rare earth-ferromagnetic metal alloy phase, about 1 up to about 15 (normally about 10 to about 15) percent by weight of the major phase. Thus, sintering aid is considered to be present in a minor amount, as a second phase.

Additive materials are particulate refractory oxides, carbides, and nitrides, which have melting points higher than the magnet sintering temperatures, used in amounts about 0.1 percent to about 2 percent by weight of the magnet composition. Suitable oxides include, without limitation, zinc oxide, magnetite, chromic oxide, aluminum oxide, calcium oxide, magnesium oxide, zirconium oxide, cupric oxide, rare earth oxides, and hydrated oxides such as tungstic acid. Metals of certain of these oxides, such as chromium and copper, have shown some effectiveness as additives, but iron does not appear to benefit the tested magnet compositions to a large extent. Certain oxides, however, such as boric oxide, palladium oxide, tantalum oxide, titanium oxide, and barium oxide, at concentrations which have been tested, either do not significantly improve magnet alloy compositions or degrade properties of the magnets. Presently preferred oxide additives are chromic oxide, aluminum oxide, and magnesium oxide.

Carbides and nitrides which are effective in the invention include tungsten carbide and titanium nitride. However, chromium carbide does not appear to be suitable.

All rare earth-containing alloys for the present invention can be prepared by simply melting together particles of rare earth metal and ferromagnetic metal, using equipment and techniques known in the art. Alternatively, co-reduction methods can be used, wherein, for example, rare earth oxide, ferromagnetic metal oxide, or a mixture thereof, is reduced at high temperature with an active metal, such as calcium. An exemplary procedure is mixing rare earth oxide, cobalt metal, and calcium, then heating in an inert atmosphere to produce a rare earth-cobalt alloy and calcium oxide. Typically, the co-reduction product is subjected to treatment for removal of the calcium oxide (see Cech et al., U.S. Pat. No. 3,625,779, described previously); certain alloy and oxide mixtures can be utilized in the present invention without separation treatment, thereby reducing the number of steps needed for producing magnets.

To prepare magnets, using a typical embodiment of the invention, the rare earth-ferromagnetic alloy powder, preferably having particle sizes up to about 10 microns, is intimately mixed with sintering aid, having a similar or smaller particle size range and distribution. Additive material, preferably having approximately the same particle sizes as alloy and sintering aid, or smaller, is added and thoroughly mixed with the other components. Magnetic domains of the mixture are aligned in a magnetic field, preferably simultaneously with a compacting step, in which a shape is formed from the powder. The shape is then sintered to form a magnet having good mechanical integrity, under conditions of vacuum or an inert atmosphere (such as argon). Typically, sintering temperatures about 950° C. to about 1,250° C. are used.

By use of the invention, permanent magnets having increased coercivity can be produced. In many magnets, the coercivity enhancement also yields a higher energy product. However, even those magnets in which only increased coercivity is obtained are made more useful for many applications, such as electric motors and microwave devices.

While the invention is not to be bound by any particular theory, it is believed that sintering of $RM_5$ magnets results in the formation of discrete $R_2M_7$ phase regions around and between the $RM_5$ particles. The additives of this invention appear to remain at the surfaces of the rare earth-ferromagnetic metal alloy and sintering aid particles, causing the sintering aid ($R_2M_7$) regions to be dispersed throughout the sintered magnet and preventing undesirable growth of the $R_2M_7$ grains.

A further possible explanation for improved results obtained depends upon a reduction in magnetic domains at the more magnetically soft $R_2M_7$ centers. As the number of domains in these centers decreases with decreased grain size, a higher resistance to demagnetization occurs. Coercivity enhancement is obtained by preventing easy propagation of domain reversal from $R_2M_7$ to $RM_5$ centers.

In general, the use of greater amounts of additive, within the aforementioned range, results in improved magnets. A point will be reached, however, after which increments of additive begin to become deleterious, since excessive additive at the boundary produces $R_2M_{17}$ inclusions, decreasing coercivity.

The invention will be further described by the following examples, which are not intended to be limiting, the invention being defined solely by the appended claims. In the examples, all percentage compositions are on a weight basis.

EXAMPLE 1

Permanent magnets are prepared, using the following procedure:

(a) particles of rare earth metal and ferromagnetic metal are melted together, using an induction furnace and an alumina crucible, to prepare an alloy having the desired composition for the major phase of a magnet;

(b) particles of rare earth metal and ferromagnetic metal are melted together, as above, to prepare an alloy to be used as a sintering aid;

(c) alloys are removed from their crucibles, adhering oxide material is removed from the surface by wire brushes, and the alloys are separately crushed and ground (in an air atmosphere) to particle sizes less than about 70 mesh, after which the particles are subjected to milling with steel balls inside an attritor mill (under toluene and an argon atmosphere);

(d) desired proportions of powdered major phase alloy, sintering aid alloy, and (if used for a particular magnet) additive are placed in a container and mixed by shaking;

(e) the mixture is placed in a cylindrical die having a diameter of 0.5 inches and loosely compacted, then subjected to 7,000 Gauss alignment field, surrounding the die, for about 5 seconds;

(f) while maintaining the alignment field, die pressure is increased, over an additional 5 seconds, to about 70,000 p.s.i.g.; and (g) shapes formed in the die are wrapped in tantalum foil and sintered under an argon atmosphere for one hour, followed by cooling to 900° C. and annealing at that temperature for about four hours and a rapid quenching to temperatures below 300° C.

Using this procedure, magnets having properties summarized in Table I are prepared. No additives are used in these preparations, which show the effect of samarium-cobalt sintering aid upon magnetic properties of praseodymium-cobalt magnets. Magnet F is a samarium-cobalt composition, for comparison, sintered at 1,120° C. All other magnets are sintered at 1,080° C.

TABLE I

| Magnet | % Pr | % Sm | $B_r$ (KG) | $H_c$ (KOe) | $iH_c$ (KOe) | $BH_{max}$ (MGOe) |
|---|---|---|---|---|---|---|
| 1A | 31.0 | 5.5 | 7.5 | 4.9 | 5.6 | 13.7 |
| 1B | 30.5 | 6.5 | 7.4 | 5.0 | 6.7 | 12.6 |
| 1C | 29.9 | 7.6 | 7.3 | 4.4 | 6.9 | 11.2 |
| 1D | 29.3 | 8.7 | 6.5 | 3.4 | 6.0 | 8.4 |
| 1E | 28.7 | 9.8 | 6.3 | 3.0 | 5.0 | 7.6 |
| 1F | 0 | 36.5 | 7.8 | 7.8 | 25.7 | 15.6 |

EXAMPLE 2

Using the procedure of the preceding example, including sintering at a temperature of 1,080° C., magnets are prepared with additives to increase coercivity. Results are summarized in Table II, demonstrating improved magnetic properties when additives are used. Magnet 2I is a comparative samarium-cobalt composition containing 36.5% Sm and no added praseodymium, sintered at 1,120° C. All other magnets have a rare earth content of 37.5% (30.0% Pr and 7.5% Sm).

Two magnets from Table II, designated 2H and 2T, are selected for metallographic examination. The ends of these magnets are ground, using 180 and 600 grit silicon carbide grinding papers, followed by polishing on a diamond wheel and, finally, on a cloth wheel, using submicron alumina dispersed in water as a polishing medium. After etching for a few seconds in a 1% nitol solution, the polished ends are examined under a microscope.

Figure 1B:
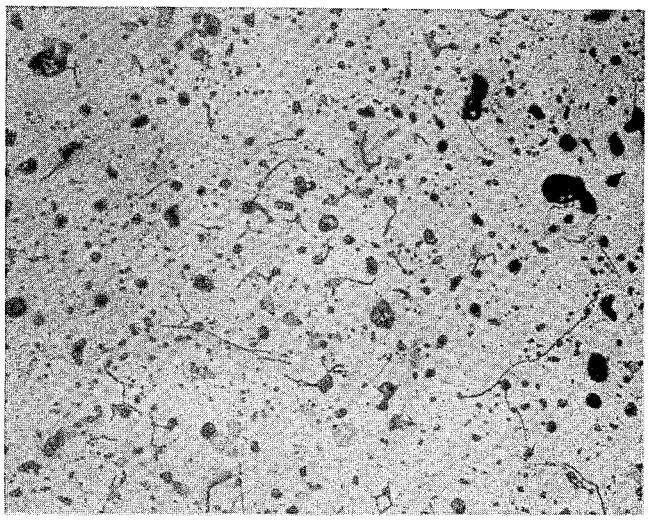
FIG. 1B is a photomicrograph showing the microstructure of a magnet prepared using a praseodymium-cobalt base alloy, a samarium-cobalt sintering aid, and an additive material for grain growth inhibition.

FIG. 1A is a photomicrograph at 500X magnification of Magnet 2T. FIG. 1B is a photomicrograph, under similar magnification, of Magnet 2H, showing the relatively greater phase dispersion obtained by using an additive.

Figure 2:
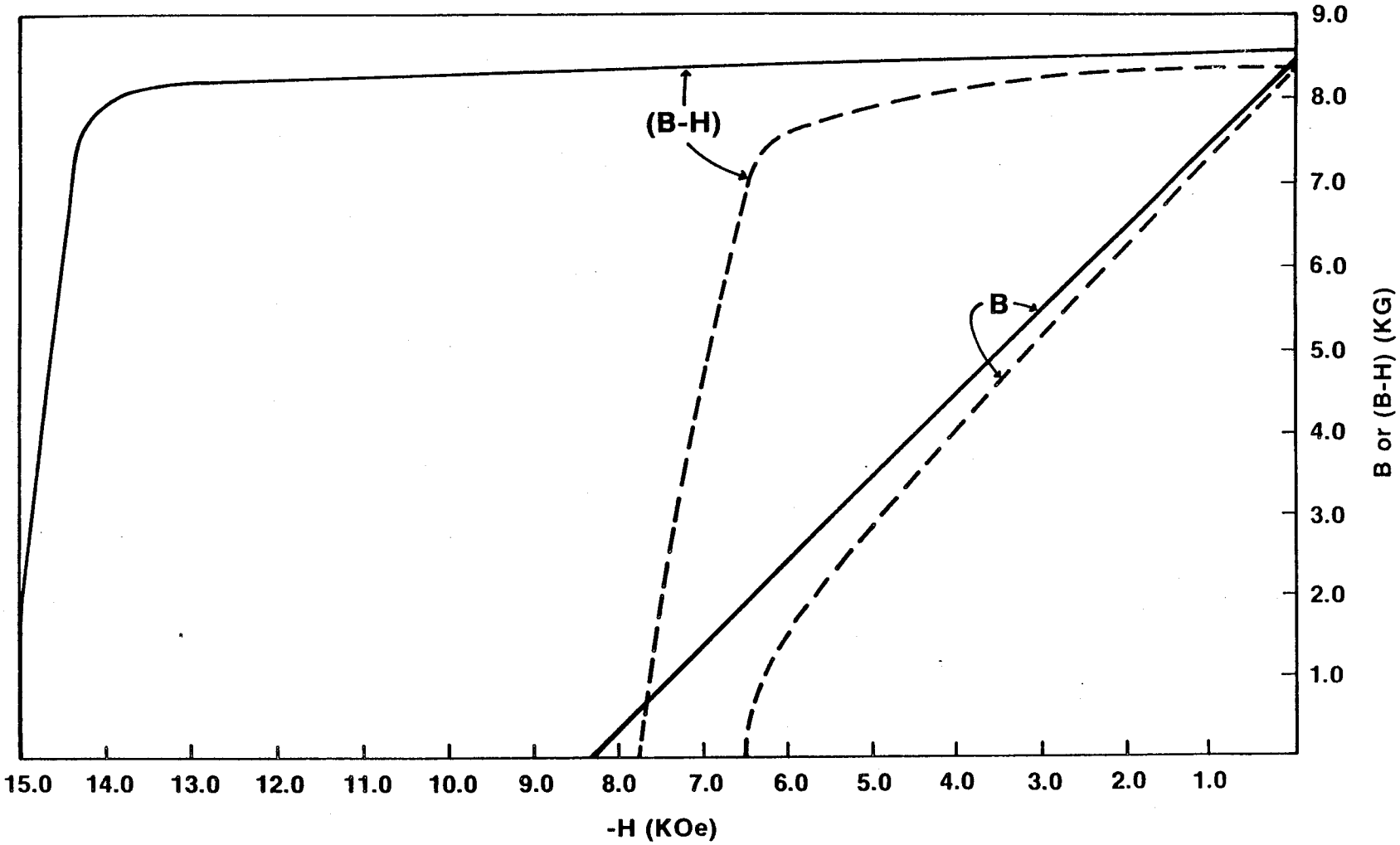
FIG. 2 is a graphical representation showing the difference in magnetic properties between magnets prepared with and without additives.

FIG. 2 shows certain magnetic properties of the two magnets. In the graph, broken lines represent data for Magnet 2T, while solid lines are for Magnet 2H. These demagnetization curves indicate the improvement in coercivity obtained with the additives. Also significant is the dramatic improvement in "squareness" of the curves, indicating the resistance of the magnet to domain reversal in a demagnetizing field.

TABLE II

| Magnet | Additive Percent | $B_r$ (KG) | $H_c$ (KOe) | $iH_c$ (KOe) | $BH_{max}$ (MGOe) |
|---|---|---|---|---|---|
| 2A | — | 6.8 | 6.0 | 11.0 | 10.5 |
| 2B | 0.44MgO | 7.8 | 7.6 | 11.2 | 15.2 |
| 2C | — | 6.0 | 2.0 | 2.1 | 6.0 |
| 2D | $0.44Al_2O_3$ | 8.0 | 6.3 | 13.5 | 14.2 |
| 2E | — | 8.1 | 6.1 | 6.7 | 15.2 |
| 2F | $0.44H_2WO_4$ | 8.0 | 7.3 | 9.3 | 15.2 |
| 2G | $0.44Fe_3O_4$ | 8.1 | 6.9 | 7.7 | 16.0 |
| 2H | $0.44Cr_2O_3$ | 8.3 | 8.2 | 14.8 | 17.4 |
| 2I | — | 7.6 | 7.6 | 25 | 14.4 |
| 2J | 0.44ZnO | 7.7 | 6.1 | 7.4 | 13.0 |
| 2K | — | 7.5 | 4.9 | 8.0 | 11.7 |
| 2L | 0.44CaO | 7.5 | 5.8 | 9.8 | 12.6 |
| 2M | $0.44ZrO_2$ | 7.5 | 5.5 | 9.5 | 12.2 |
| 2N | — | 7.6 | 5.6 | 8.7 | 12.9 |
| 2O | 0.44BaO | 6.7 | 3.3 | 7.8 | 6.6 |
| 2P | $0.44Ta_2O_5$ | 7.7 | 5.5 | 9.4 | 13.3 |
| 2Q | — | 7.3 | 5.5 | 9.0 | 11.9 |
| 2R | $0.44TiO_2$ | 7.3 | 5.0 | 10.2 | 11.7 |
| 2S | 0.44CuO | 7.4 | 6.4 | 11.8 | 13.0 |
| 2T | — | 8.0 | 6.5 | 7.8 | 15.2 |
| 2U | 1.5WC | 7.9 | 7.7 | 9.9 | 15.2 |
| 2V | $1.5Cr_2C_3$ | 0 | 0 | 0 | 0 |

TABLE II-continued

| Magnet | Additive Percent | $B_r$ (KG) | $H_c$ (KOe) | $iH_c$ (KOe) | $BH_{max}$ (MGOe) |
|---|---|---|---|---|---|
| 2W | — | 7.7 | 5.5 | 8.9 | 12.8 |
| 2X | 0.44TiN | 7.7 | 5.8 | 9.3 | 13.4 |

EXAMPLE 3

The effect of varying additive content is shown by preparing magnets containing chromic oxide, using three separately produced alloy powder mixtures having a similar analysis (30% Pr, 7.5% Sm, and 62.5% Co). Portions of the mixtures are blended with a desired amount of powdered chromic oxide, and subjected to steps (e) through (g) of the procedure described in Example 1, supra. Sintering is at a temperature of 1,080° C.

Results summarized in Table III indicate that the amount of additive used affects magnetic properties.

TABLE III

| Magnet | % $Cr_2O_3$ | $B_r$ (KG) | $H_c$ (KOe) | $iH_c$ (KOe) | $BH_{max}$ (MGOe) |
|---|---|---|---|---|---|
| | | (Powder Mixture "A") | | | |
| 3A | 0 | 7.6 | 4.0 | 5.5 | 12.0 |
| 3B | 0.44 | 8.1 | 6.6 | 13.2 | 15.0 |
| 3C | 0.88 | 8.6 | 8.2 | 14.7 | 18.1 |
| 3D | 1.17 | 8.0 | 5.0 | 8.3 | 12.4 |
| 3E | 0 | 7.7 | 4.0 | 5.3 | 12.1 |
| 3F | 0.88 | 8.6 | 8.2 | 14.4 | 18.2 |
| 3G | 1.04 | 8.4 | 8.2 | 17.0 | 17.6 |
| | | (Powder Mixture "B") | | | |
| 3H | 0 | 7.8 | 4.8 | 5.9 | 12.6 |
| 3I | 0.88 | 8.7 | 8.4 | 15.6 | 18.5 |
| 3J | 1.02 | 8.5 | 7.7 | 15.6 | 17.2 |
| 3K | 0 | 7.8 | 5.2 | 6.0 | 13.2 |
| 3L | 0.88 | 8.4 | 8.1 | 17.0 | 17.2 |
| | | (Powder Mixture "C") | | | |
| 3M | 0 | 7.7 | 4.8 | 5.3 | 13.1 |
| 3N | 0.88 | 8.4 | 7.8 | 14.2 | 17.2 |

EXAMPLE 4

Using the procedure of Example 1, as alloy containing 34% Pr and 66% Co is mixed with a sintering aid containing 60% Pr and 40% Co to form a mixture which contains 38% Pr, and used to produce permanent magnets. Sintering is at a temperature of 1,040° C., yielding the results summarized in Table IV.

TABLE IV

| Magnet | % $Cr_2O_3$ | $B_r$ (KG) | $H_c$ (KOe) | $iH_c$ (KOe) | $BH_{max}$ (MGOe) |
|---|---|---|---|---|---|
| 4A | — | 5.9 | 3.0 | 3.3 | 7.0 |
| 4B | 0.50 | 6.6 | 5.5 | 7.5 | 10.8 |
| 4C | 0.75 | 6.7 | 5.9 | 9.9 | 11.8 |

EXAMPLE 5

By sintering at various temperatures, while using the procedure of Example 1, it is seen that use of the additives of this invention can compensate for sintering temperature-related coercivity losses, while permitting the higher magnet densities and long-term mechanical strength obtained by high-temperature sintering. Results are summarized in Table V, wherein all magnets contain 30% Pr and 7.5% Sm.

TABLE V

| Magnet | % $Cr_2O_3$ | Temp (°C.) | $B_r$ (KG) | $H_c$ (KOe) | $iH_c$ (KOe) | $BH_{max}$ (MGOe) |
|---|---|---|---|---|---|---|
| 5A | 0.5 | 1,080 | 8.3 | 7.3 | 17.6 | 16.4 |
| 5B | 0.5 | 1,090 | 8.3 | 5.2 | 7.6 | 14.5 |
| 5C | 0.5 | 1,100 | 8.2 | 5.3 | 7.3 | 14.1 |
| 5D | — | 1,100 | 6.7 | 2.9 | 4.0 | 6.1 |

Various embodiments and modifications of this invention have been described in the foregoing description and examples, and further modifications will be apparent to those skilled in the art. Such modifications are included within the scope of the invention as defined by the following claims.

What is claimed is:

1. A method for producing rare earth-ferromagnetic metal alloy permanent magnets, comprising the steps of:

(a) mixing a particulate additive material selected from the group consisting of refractory oxides, carbides, and nitrides, in an amount which provides about 0.1 percent to about 2 percent by weight additive material in the mixture, with a major amount of a particulate rare earth-ferromagnetic metal alloy and a minor amount of a particulate sintering aid alloy;

(b) aligning magnetic domains of the mixture in a magnetic field;

(c) compacting the aligned mixture to form a shape; and (d) sintering the compacted shape.

2. The method defined in claim 1 wherein all components of the mixture have been reduced to particle sizes less than about 10 microns.

3. The method defined in claim 1 wherein the sintering aid comprises up to about 15 percent by weight of the mixture.

4. The method defined in claim 3 wherein the sintering aid comprises about 10 percent to about 15 percent by weight.

5. The method defined in claim 1 wherein, during sintering, at least a portion of the sintering aid is liquid.

6. The method defined in claim 1 wherein the rare earth-ferromagnetic metal alloy has an empirical formula corresponding approximately to $RM_5$, wherein R is rare earth and M is ferromagnetic metal.

7. The method defined in claim 6 wherein R is praseodymium.

8. The method defined in claim 6 wherein M is cobalt.

9. The method defined in claim 1 wherein the rare earth-ferromagnetic metal alloy has an empirical formula corresponding approximately to $RM_2$, wherein R is rare earth and M is ferromagnetic metal.

10. The method defined in claim 1 wherein the rare earth-ferromagnetic metal alloy has an empirical formula corresponding approximately to $R_2M_7$, wherein R is rare earth and M is ferromagnetic metal.

11. The method defined in claim 1 wherein the rare earth-ferromagnetic metal alloy has an empirical formula corresponding approximately to $R_2M_{17}$, wherein R is rare earth and M is ferromagnetic metal.

12. The method defined in claim 1 wherein the sintering aid is an alloy containing an excess of rare earth over the amount required to form $RM_5$, wherein R is rare earth and M is ferromagnetic metal.

13. The method defined in claim 1 wherein the sintering aid is an alloy of a ferromagnetic metal and a rare earth selected from the group consisting of praseodymium, samarium, and mixtures thereof.

14. The method defined in claim 1 wherein the sintering aid is an alloy of rare earth metal and cobalt.

15. The method defined in claim 1 wherein the additive material is an oxide.

16. The method defined in claim 1 wherein the additive material is an oxide of a metal selected from the group consisting of chromium, aluminum, and magnesium.

17. A method for producing praseodymium-cobalt based magnets, comprising the steps of:

(a) mixing together the components:

(i) a particulate praseodymium-cobalt alloy, having an empirical formula corresponding approximately to $PrCo_5$;

(ii) a lesser amount of a particulate sintering aid alloy selected from the group consisting of praseodymium-cobalt alloys, samarium-cobalt alloys, praseodymium-samarium-cobalt alloys, and mixtures thereof; and (iii) a particulate additive selected from the group consisting of refractory oxides, carbides, and nitrides, in amounts to comprise about 0.1 to about 2 percent by weight of the mixture;

(b) aligning magnetic domains of the mixture in a magnetic field;

(c) compacting the aligned mixture to form a shape; and (d) sintering the compacted shape at temperatures which cause at least a portion of the sintering aid to become liquid.

18. The method defined in claim 17 wherein all components of step (a) have particle sizes less than about 10 microns.

19. The method defined in claim 17 wherein the sintering aid comprises about 10 to about 15 percent by weight of the mixture of step (a).

20. The method defined in claim 17 wherein the sintering aid alloy contains an excess of rare earth over an amount required to form $RCo_5$, wherein R is praseodymium, samarium, or mixtures thereof.

21. The method defined in claim 17 wherein the additive is an oxide.

22. The method defined in claim 17 wherein the additive is an oxide of a metal selected from the group consisting of chromium, aluminum, and magnesium.

* * * * *